US006016132A

United States Patent [19]

Takahashi

[11] Patent Number: 6,016,132

[45] Date of Patent: Jan. 18, 2000

[54] GRADATION CONTROLLED LED DISPLAY DEVICE AND METHOD FOR CONTROLLING THE SAME

[75] Inventor: Nozomu Takahashi, Kanagawa-ken, Japan

[73] Assignee: Kabushiki Kaisha Toshiba, Kanagawa-ken, Japan

[21] Appl. No.: 09/007,765

[22] Filed: Jan. 15, 1998

[30] Foreign Application Priority Data

Jan. 22, 1997 [JP] Japan ..... 9-009746

[51] Int. Cl.[7] ..... G09G 3/32; G09G 5/10

[52] U.S. Cl. ..... 345/82; 345/83; 345/147

[58] Field of Search ..... 345/82, 83, 147, 345/148

[56] References Cited

U.S. PATENT DOCUMENTS

| | | | |
|---|---|---|---|
| 5,638,091 | 6/1997 | Sarrasin | 345/147 |
| 5,708,452 | 1/1998 | Takahashi | 345/82 |
| 5,717,417 | 2/1998 | Takahashi | 345/82 |

*Primary Examiner*—Richard A. Hjerpe
*Assistant Examiner*—Duc Dinh
*Attorney, Agent, or Firm*—Finnegan, Henderson, Farabow, Garrett & Dunner, L.L.P.

[57] ABSTRACT

A gradation controlled LED display device has an LED array having a matrix of LED chips. The lighting time of each of the LED chips is controlled to display one of gradation levels. The display device has a gradation control circuit, linearity adjusting circuits, and a base-resistance selector that are connected to data lines, which are connected to the LED chips. The gradation control circuit controls the lighting time of each LED chip according to 8-bit display data, to display one of 255 gradation levels. The linearity adjusting circuit determines whether or not five upper bits of given 8-bit display data are all "zero" and provides a resultant signal. If the resultant signal indicates that the five upper bits are all "zero", the base-resistance selector selects a large base resistance value, and if any one of the five upper bits is "1", a small base resistance value. In this way, a base resistance value applied to the base of a pnp transistor of a data driver for driving one data line is selected between the large and small values, to sharply turn on and off the pnp transistor at low gradation levels. This arrangement clearly distinguishes the lighting times of low gradation levels from one another and improves the contrast of low gradation levels.

20 Claims, 9 Drawing Sheets

GRADATION CONTROLLED LED DISPLAY DEVICE AND METHOD FOR CONTROLLING THE SAME

BACKGROUND OF THE INVENTION

1. Field of the Invention

The present invention relates to a gradation controlled LED display device having a matrix of LED chips and a method for controlling the lighting time of each of the LED chips so that each LED chip may provide a gradation level corresponding to the lighting time.

2. Description of the Prior Art

Among display devices including color television sets, those employing a matrix of LED chips are widely used because they have a relatively long service life and are easy to form a large screen by combination of a plurality of display units each having the matrix of LED chips. In particular, gradation controlled LED display devices that control the lighting time of each LED chip to display gradation levels are spotlighted.

FIG. 1A is a block diagram showing a gradation controlled LED display device according to a prior art. An LED array 101 has LED chips 101*a* of three primary colors, or the red (R), green (G), and blue (B) colors that are arranged in a triple matrix consisting of R, G and B 16×32-dot matrices. A data input control circuit 103 receives R, G, and B display data each of 8 bits in response to a clock signal CK1 while a select signal SE is being high. The 8-bit display data for red consists of bits RA to RH, that for green GA to GH, and that for blue BA to BH. These R, G, and B display data pieces are supplied to RAMs 105R, 105G, and 105B, respectively. Each piece of 8-bit display data corresponds to a dot and represents one of 255 gradation levels. The RAMs 105R, 105G, 105B accumulate 8-bit display data for 32 dots each and supply them to a gradation control circuit 107. According to the display data, the gradation control circuit 107 controls the lighting time of each LED chip so that the LED chip may provide one of the 255 gradation levels. A data driver 109 receives the gradation controlling display data from the gradation control circuit 107 and simultaneously drives 96 (32 each for R, G, and B) LED chips 101*a* according to the display data.

A reset signal RE resets 4-bit counters 111*a* and 111*b*, which are arranged in two stages and operate in synchronization with the clock signal CK1. The output of the 4-bit counter 111*b* is given to a 4-to-16 decoder 113, and the output of the decoder 113 is given to a scan driver 115. The scan driver 115 sequentially scans the LED chips 101*a*, 96 at a time, whenever the data driver 109 drives 96 of the LED chips 101*a*.

FIG. 1B shows the details of the red matrix of the LED array 101. The LED array 101 includes 3×32=96 data lines p1 to p96 and 16 scan lines s1 to s16. The red matrix corresponds to data lines p1 to p32. The green and blue matrices correspond to data lines p33 to p64 and p65 to p92 respectively. The data line p33 neighbors to data line p1. The data line p65 neighbors to data line p33 so that the data lines p1, p33 and p65 constitute a set of data lines. The data lines p2, p34 and p66 constitute another set of data lines. The LED chips 101*a* are connected to the data and scan lines at the intersections of these lines. The data lines are connected to output terminals of the data driver 109, and the scan lines are connected to output terminals of the scan driver 115.

FIG. 1C is a time chart briefly showing the operation of the red matrix in the display device of FIG. 1A. At t1, a pulse of the reset signal RE resets the 4-bit counters 111*a* and 111*b*. At t2, the select signal SE becomes "high" to activate the data input control circuit 103. At t3, a bright signal BR (not shown in FIG. 1A) becomes "high" to disable a display operation.

At t4, a first pulse of the clock signal CK1 rises. In synchronization with the first to 32nd pulses of the clock signal CK1, the data input control circuit 103 fetches R display data pieces of 8 bits, and the RAM 105R accumulates the display data for 32 dots for the first scan line s1. Although now shown in FIG. 1C, the data input control circuit 103 also fetches G and B display data pieces each of 8 bits, and the RAMs 105G and 105B accumulate the display data for 32 dots each, for the first scan line s1.

Between t5 and t6 where the bright signal BR is "low", the display data for the scan line s1 are transferred to the gradation control circuit 107, which controls the gradation levels of the red LED chips in the scan line s1 according to the display data. The gradation controlling display data are supplied to the data driver 109, which drives the red LED chips 101*a* in the scan line s1 that is scanned by the scan driver 115. As a result, the red LED chips in the scan line s1 display gradation levels based on the display data.

A period between t6 and t7 resembles the period between t3 and t5. Namely, the RAM 105R accumulates display data for 32 dots for the second scan line s2, and the red LED chips in the scan line s2 display gradation levels corresponding to the display data after t7 when the bright signal BR becomes "low". Similarly, display data pieces are supplied and displayed up to the scan line s16. When the select signal SE becomes "low" at t8, the red LED chips in the scan line s16 display gradation levels, and the operation of the data input control circuit 103 terminates.

FIG. 1D is a circuit diagram showing one of 96 unit circuits that form the data driver 109. The unit circuit consists of an npn bipolar transistor 117, a pnp bipolar transistor 119, a first base resistor 121, a bypass resistor 123, a current limiting resistor 124, and a second base resistor 125. The unit circuit also has an input terminal 127 connected to the gradation control circuit 107, and an output terminal 129 connected to one of the data lines.

When the input terminal 127 receives a display signal of "high" from the gradation control circuit 107, a base current flows through the first base resistor 121 to turn on the npn transistor 117. As a result, a current flows from a power supply through the bypass resistor 123, second base resistor 125, and transistor 117, to turn on the pnp transistor 119. This makes the output terminal 129 "high" to activate the corresponding data line.

FIG. 2 shows the lighting times of some of 255 gradation levels controlled by the gradation control circuit 107. Ideally, the fall and rise of each lighting time must involve no delay time as indicated with a dashed line. However, each lighting time involves actually a rise delay of $\alpha$ as indicated with a solid line. The representative value of a is one to two micro seconds.

This rise delay is caused because the turn-off characteristic of each pnp transistor 119 of the data driver 109 is poor. In the data driver of the conventional gradation controlled LED display device, the resistance of the second base resistor 125 is small, and a large base current flows to the pnp transistor 119, which cause the storage delay time associated with the excursion of the pnp transistor 119 into the saturation region.

As is apparent in FIG. 2, the rise delay or the turn-off time $\alpha$ is constant on every gradation level. Among 255 lighting times to display 255 gradation levels, the ratio of the turn-off time a to the lighting times becomes larger toward lower gradation levels, in particular, gradation levels 1 to 7. The representative lighting time for the lowest gradation level (level 1) is 0.1~0.5 micro second. This is the reason why the conventional display devices are incapable of clearly displaying low gradation levels with required brightness. As shown in FIG. 3, the conventional display devices are incapable of securing good linearity in relative brightness at lower gradation levels.

To improve linearity in relative brightness at lower gradation levels, the turn-off characteristic of the pnp transistor 119 must be improved. It may be possible to employ a uniform large base resistance 125 for each pnp transistor 119 so as to reduce the turn-off time. But, we must consider the thermal limitation of the matrix of LED chips, in which a multitude of heat generating elements are assembled in a limited area. If the operation points of all the pnp transistors 119 always reside in the active region which requires a higher collector voltage ($V_C$E), by using the uniform large base resistance, the total thermal energy generated by these transistors becomes very large because the transistor in the active region dissipates large power. Then the reliability of the display device may be deteriorated. Further, the value of the current limiting resistor 124 must be enlarged to assure a stable operation of the display device, which requires a larger supply voltage and increases the power dissipation of the data driver 109, in general, to deteriorate the reliability further. As a result, the employment of the uniform large base resistance 125 is not a preferable circuit configuration.

SUMMARY OF THE INVENTION

An object of the present invention is to provide a gradation controlled LED display device capable of realizing an excellent linearity in relative brightness at low gradation levels and improving contrast at low gradation levels.

Another object of the present invention is to provide a gradation controlled LED display device which dissipates low power and guarantees a high reliability.

Still another object of the present invention is to provide a method of controlling gradation levels displayed on an LED display device, so that relative brightness at low gradation levels has a marvelous linearity to display the low gradation levels with clear contrast.

An additional object of the present invention is to provide a method of controlling gradation levels on an LED display device so that the power dissipated in the LED display device can be reduced to guarantee a high reliability.

In order to accomplish the objects, a first aspect of the present invention provides a gradation controlled LED display device having at least (a) an LED array having a matrix of LED chips, (b) a data input control circuit for receiving display data, each piece of the display data being composed of a plurality of bits, (c) a gradation control circuit for controlling the lighting times of the LED chips according to the display data so that the LED chips may provide gradation levels corresponding to the lighting times, (d) a data driver having at least transistors for driving a predetermined number of the LED chips according to the lighting times, (e) a base current control circuit for determining base currents supplied to the transistors of the data driver according to the display data, and (f) a scan circuit for scanning the predetermined number of the LED chips at a time, whenever the data driver drives the predetermined number of the LED chips. Determining base currents supplied to the transistors is realized by, for example, preparing large and small base currents and by selecting one of them through the base current control circuit according to whether or not several upper bits of each piece of the display data are all "zero".

The first aspect determines base currents supplied to the transistors of the data driver according to the contents of display data, for example, whether or not several upper bits of a given piece of display data are all "zero". A base current for lower gradation levels is set to be smaller than that for higher gradation levels, to improve the turn-off characteristic of the transistors with respect to the low gradation levels. Namely, the first aspect eliminates the excursion of the transistors into the saturation region so as to suppress excessive minority carrier injection to the base region of each transistor at a low gradation level of the LED chips, to shorten a turn-off time of the transistor at the low gradation level. As a result, lighting time of the LED chips for low gradation levels become distinguishable from one another, to provide clear contrast at the low gradation levels.

More precisely, the base current control circuit of the first aspect prepares two base resistance values for each transistor of the data driver and selects one of them according to display data. The first aspect may employ a linearity adjusting circuit to detect several upper bits of given display data. If the linearity adjusting circuit determines that the several upper bits are all "zero", a larger one of the resistance values is selected. If the linearity adjusting circuit determines that any one of the several upper bits is "1", the lower resistance value is selected. In this way, the first aspect selects one of the two base resistance values for each transistor of the data driver and selects the larger one for low gradation levels, to reduce the turn-off time of the transistor with respect to the low gradation levels.

For example, the linearity adjusting circuit detects five upper bits of 8-bit display data, to improve the contrast of low gradation levels 1 to 7 among 255 gradation levels.

More generally, if each piece of display data consists of N ($N \geqq 7$) bits to display the number of gradation levels of $$\sum_{n=1}^{N} 2^{n-1},$$

the linearity adjusting circuit detects the fourth and upper bits counted from the least significant bit of given N-bit display data, to improve the contrast of the low gradation levels 1 to 7 among the gradation levels expressed as mentioned above.

A second aspect of the present invention provides a method of controlling a gradation controlled LED display device, including at least the steps of determining whether or not several upper bits of a given display data piece are all "zero", the display data piece specifying a lighting time of one of LED chips arranged in a matrix, selecting, according to the determination, a base current supplied to a corresponding one of transistors of a data driver for driving data lines connected to a predetermined number of the LED chips, turning on and off the transistors, and sequentially scanning the LED chip matrix scan line by scan line whenever driving the data lines.

The second aspect checks to see if several upper bits of each display data piece are all "zero", and according to a result of the checking, selects base currents supplied to the transistors of the data driver, to suppress carrier storage effect for low gradation levels, shorten a turn-off time of the transistors with respect to the low gradation levels, and provide required contrast at the low gradation levels.

Other and further objects and features of the present invention will become obvious upon an understanding of the illustrative embodiment about to be described in connection with the accompanying drawings or will be indicated in the appended claims, and various advantages not referred to herein will occur to one skilled in the art upon employing of the invention in practice.

DETAILED DESCRIPTION OF THE EMBODIMENTS

Figure 1A:
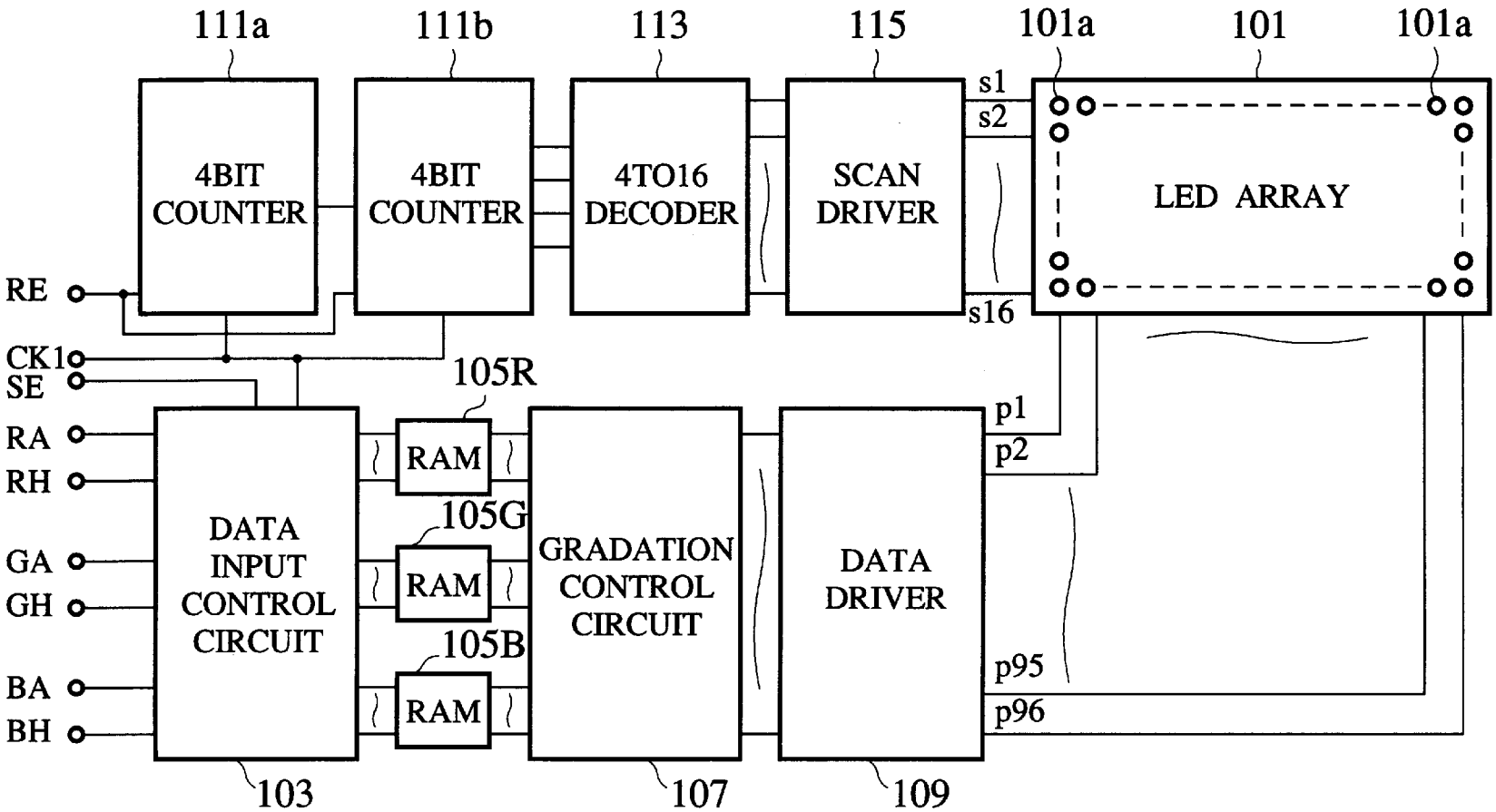
FIG.1A PRIOR ART
FIG. 1A is a block diagram showing a gradation controlled LED display device according to a prior art.
Figure 1B:
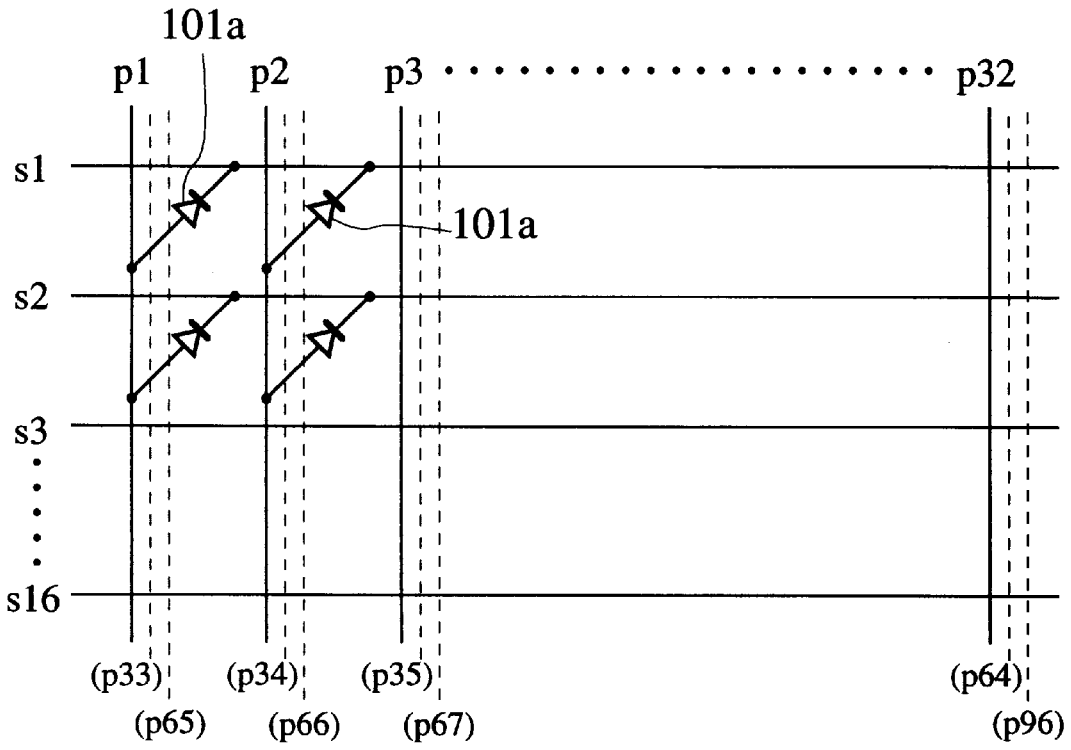
FIG.1B PRIOR ART
FIG. 1B shows the details of a red matrix in the LED array of the display device of FIG. 1A.
Figure 1C:
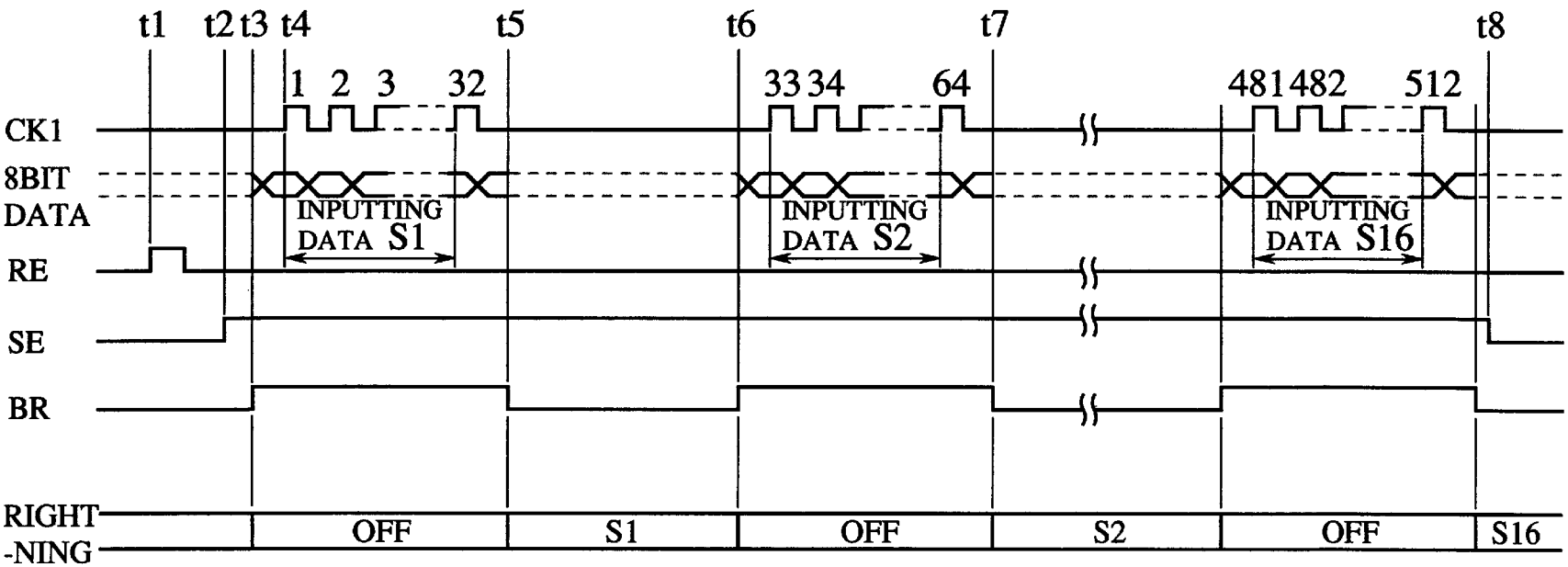
FIG.1C PRIOR ART
FIG. 1C is a time chart showing the operation of the display device of FIG. 1A.
Figure 1D:
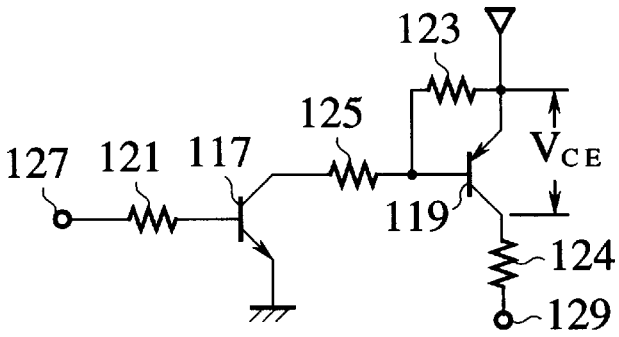
FIG.1D PRIOR ART
FIG. 1D shows one of unit circuits that form a data driver of the display device of FIG. 1A.
Figure 2:
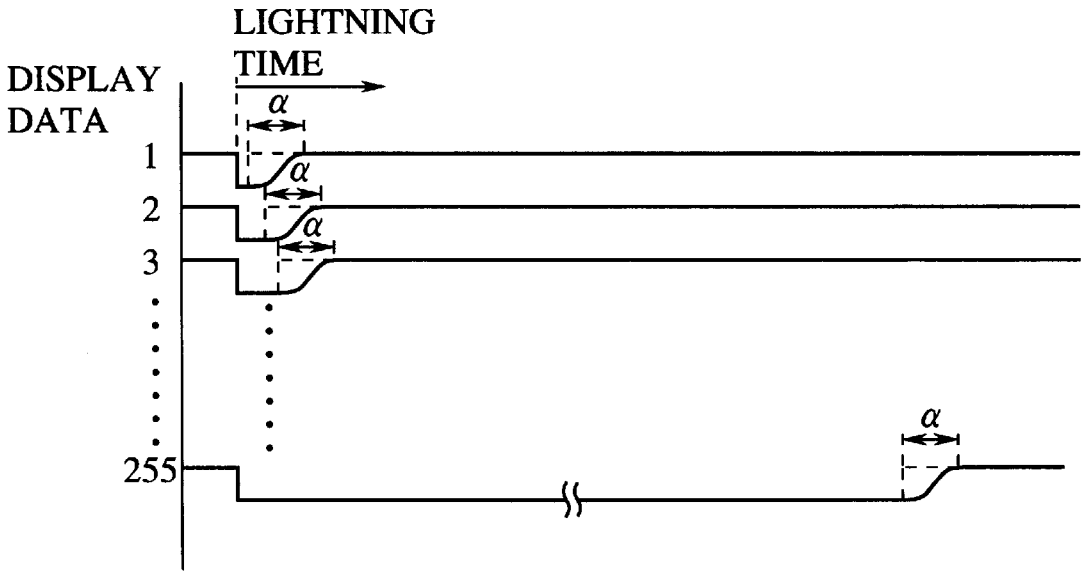
FIG.2 PRIOR ART
FIG. 2 shows lighting times corresponding to gradation levels displayed on the display device of the prior art.

An embodiment of the present invention will be described with reference to the accompanying drawings. It is to be noted that the same or similar reference numerals are applied to the same or similar parts and elements throughout the drawings, and the description of the same or similar parts and elements will be omitted or simplified.

Figure 4A:
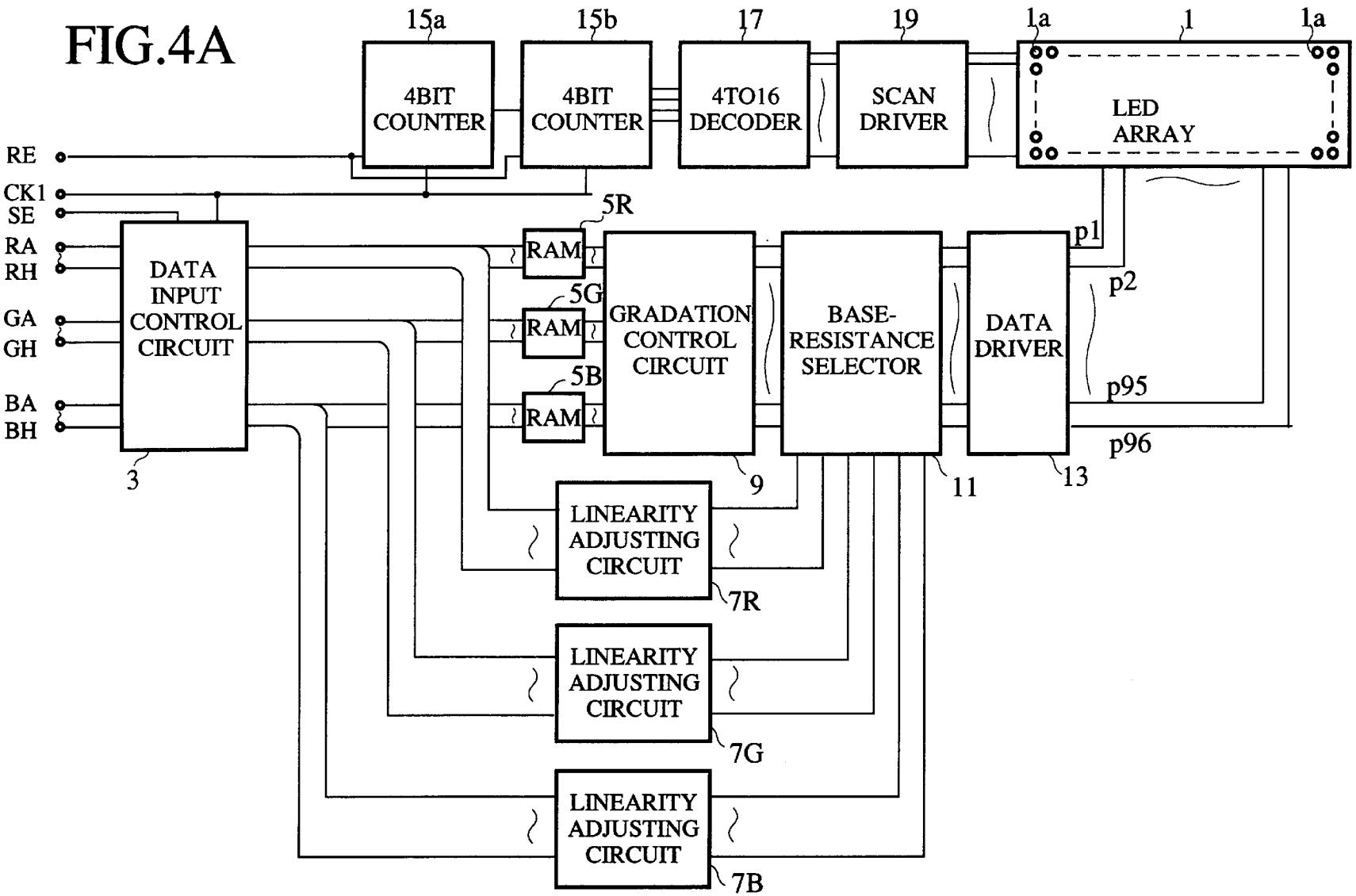
FIG. 4A is a block diagram showing a gradation controlled LED display device according to an embodiment of the present invention.

FIG. 4A is a block diagram showing a gradation controlled LED display device according to the embodiment of the present invention. The display device has at least an LED array 1 consisting of a matrix of LED chips 1*a,* a data input control circuit 3 for receiving display data pieces each consisting of a plurality of bits, a gradation control circuit 9 for controlling the lighting times of the LED chips 1*a* according to the display data so that the LED chips may display gradation levels corresponding to the lighting times, a data driver 13 for driving the LED chips 1*a* according to the lighting times, a base-current control circuit (7R, 7G, 7B, 11) for determining base currents supplied to transistors of the data driver 13 according to the red (R), green (G) and blue (B) display data, and a scan circuit (15*a,* 15*b,* 17, 19) for sequentially scanning the LED chips 1*a*. The base-current control circuit includes a linearity adjusting circuits 7R, 7G, 7B for detecting whether or not several upper bits of the R, G and B display data are all "zero", respectively, and a base-resistance selector 11. The base-resistance selector 11 includes, for each data line, two base resistors having different resistance values. If the linearity adjusting circuits 7R, 7G, 7B determine that several upper bits of a given piece of display data are all "zero", the selector 11 selects one having a larger resistance value of the base resistors. If the linearity adjusting circuits 7R, 7G, 7B determine respectively that any one of the several upper bits of the R, G and B display data is "1", the selector 11 selects the other base resistor having a smaller resistance value. Memories (RAMs) 5R, 5G, and 5B for accumulating the R, G, and B display data, respectively, are arranged between the data input control circuit 3 and the gradation control circuit 9.

The LED array 1 includes R, G, and B matrices of LED chips 1*a,* each arranged in a matrix of 16×32 dots. Each one of the R, G, and B LED chips form an RGB pixel, and therefore, the LED array 1 is made of a triple matrix of 16×32 RGB pixels. The data input control circuit 3 receives R, G, and B display data consisting of eight bits RA to RH, GA to GH, and BA to BH, respectively, in response to a clock signal CK1 while a select signal SE is being "high". The R, G, and B display data are stored in the RAMs 5R, 5G, and 5B, respectively, and at the same time, are supplied to the linearity adjusting circuits 7R, 7G, 7B. One piece of the 8-bit display data corresponds to one LED chip 1*a* and represents one of 255 gradation levels.

Each of the RAMs 5R, 5G, and 5B accumulates 8-bit display data for 32 dots and supplies the accumulated display data to the gradation control circuit 9. The gradation control circuit 9 controls the lighting time of each LED chip 1*a* according to the 8-bit display data, to display one of the 255 gradation levels.

Figure 4B:
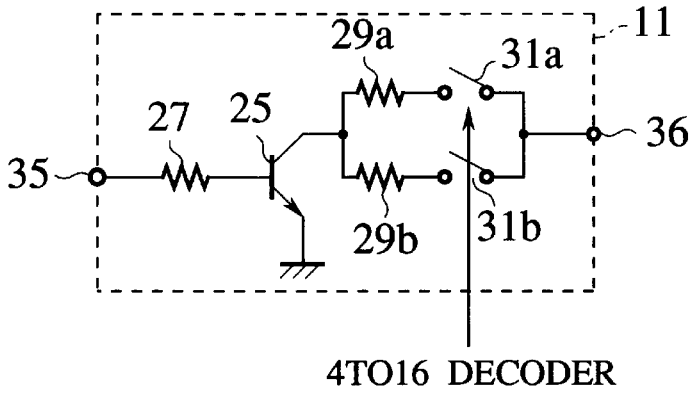
FIG. 4B is a circuit diagram showing a base-resistance selector of the display device of FIG. 4A.

Each of the linearity adjusting circuits 7R, 7G, 7B determines whether or not five upper bits of a given piece of 8-bit display data are all "zero" and supplies a resultant signal to the base-resistance selector 11. FIG. 4B shows the details of one of 96 unit circuits of the base-resistance selector 11. The unit circuit has an npn transistor 25, a first series circuit, and a second series circuit. The first series circuit consists of a first base resistor 29*a* and a first switch 31*a*. The second series circuit consists of a second base resistor 29*b* whose resistance is larger than that of the first base resistor 29*a,* and a second switch 31*b*. The first and second series circuits form a parallel circuit. The base terminal of npn transistor 25 is electrically coupled to the gradation control circuit 9 through resistor 27 and input terminal 35. The npn transistor 25 further has an emitter terminal connected to a ground level, and a collector terminal connected to the parallel circuit. One of the first and second base resistors 29*a* and 29*b* is selected according to a signal provided by the linearity adjusting circuits 7R, 7G, 7B. The gradation control circuit 9 provides the base-resistance selector 11 with gradation controlling display data, and the output of the base-resistance selector 11 is given to the data driver 13.

According to the gradation controlling display data, the data driver 13 simultaneously drives the LED chips 1*a* in a specified scan line. The display device also has 4-bit counters 15*a* and 15*b* arranged in two stages as shown in FIG. 4A. The 4-bit counters 15*a* and 15*b* are reset by a reset signal RE and operate in synchronization with the clock signal CK1. The output of the 4-bit counter 15*b* is given to a 4-to-16 decoder 17 whose output is given to a scan driver 19. The scan driver 19 sequentially scans the LED chips 1*a* scan line by scan line. Each scan line includes 96 LED chips 1*a*, i.e., 32 RGB pixels.

Figure 4C:
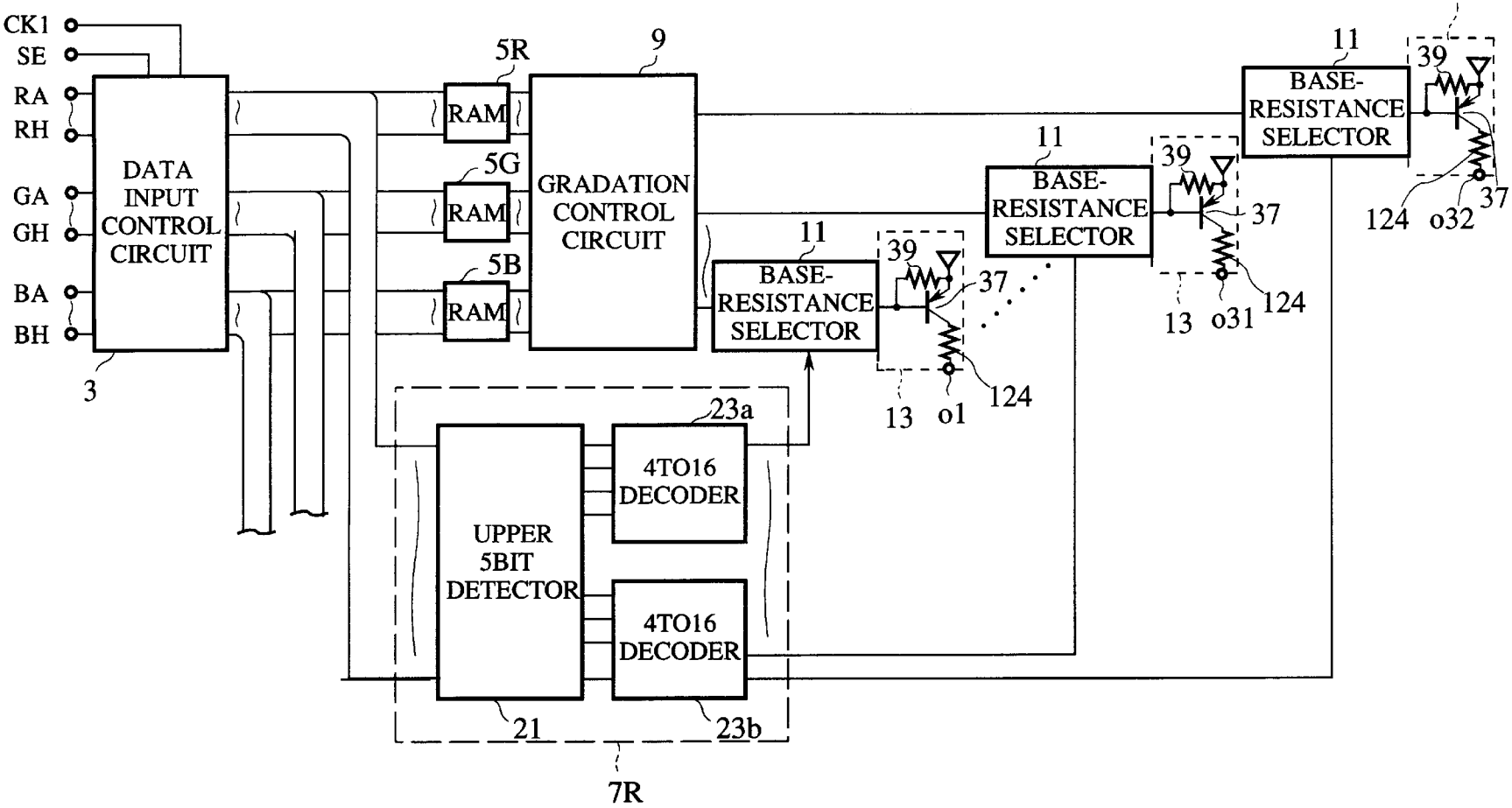
FIG. 4C is a block diagram showing arrangements between a data input control circuit and a data driver related to a red matrix of the display device of FIG. 4A.

FIG. 4C shows the details of the red (R) linearity adjusting circuit 7R for R display data and base-resistance selector 11, and a route from the data input control circuit 3 to the data driver 13. Although not shown in FIG. 4C, the green (G) linearity adjusting circuit 7G and the blue (B) linearity adjusting circuit 7B are provided for each of G and B display data. Each of the linearity adjusting circuits 7R, 7G, 7B consists of an upper-5-bit detector 21 and two 4-to-16 decoders 23*a* and 23*b*. The detector 21 determines whether or not five upper bits of a given piece of 8-bit display data from the data input control circuit 3 are all "zero" and provides 4-bit resultant data to each of the decoders 23*a* and 23*b*. The 4-bit resultant data differs depending on whether or not the 8-bit display data represents one of low gradation levels 1 to 7 among 255 gradation levels. The decoders 23*a* and 23*b* convert each the 4-bit resultant data into 16-bit data and provide a 32-bit signal. The 32 bits of this signal are supplied to 32 of the unit circuits of the base-resistance selector 11, respectively.

In each unit circuit of the base-resistance selector 11, the first base resistor 29*a* has a small resistance value like the prior art, and the second base resistor 29*b* has a larger resistance value than the first base resistor 29*a* that is selected only when the gradation level to be displayed is one of 1 to 7. One of the first and second switches 31*a* and 31*b* turns on in response to a signal from one of the 4-to-16 decoders 23*a* and 23*b*. An input terminal 35 of the unit circuit of the selector 11 is connected to the gradation control circuit 9, and an output terminal 36 thereof is connected to the data driver 13. The selector 11 has 96 such unit circuits, i.e., 32 each for R, G, and B.

If the upper-5-bit detector 21 determines that five upper bits of given 8-bit display data are all "zero", a resultant signal indicating the fact is supplied through one of the 4-to-16 decoders 23*a* and 23*b*, to turn on the second switch 31*b* of the corresponding unit circuit of the base-resistance selector 11. As a result, the second base resistor 29*b* having the large resistance value is selected. If the detector 21 determines that at least one of the five upper bits is "1", the first switch 31*a* is turned on to select the first base resistor 29*a* having the small resistance value. The gradation control circuit 9 supplies gradation-controlling display data simultaneously to 96 unit circuits of the data driver 13. As shown in FIG. 4C, each unit circuit of the data driver 13 consists of a pnp transistor 37, a bypass resistor 39 and a current limiting resistor 124. An output terminal of the unit circuit is connected to a corresponding data line and becomes "high" in response to display data provided by a corresponding unit circuit of the base-resistance selector 11, to drive the corresponding red data line. The unit circuits of the data driver 13 simultaneously drive the respective red data lines, i.e., the respective red LED chips 1*a*.

In this way, the present invention employs the linearity adjusting circuits 7R, 7G, 7B to detect whether or not five upper bits of given 8-bit display data are all "zero". A result of the detection selects one of the first and second base resistors 29*a* and 29*b* having different resistance values of a corresponding unit circuit of the base-resistance selector 11. If all of the five upper bits are "zero", i.e., if the display data represents one of gradation levels 1 to 7, the present invention selects the second base resistor 29*b* of large resistance, to reduce a base current flowing into the corresponding pnp transistor 37 of the data driver 13. This prevents the operating point of pnp transistor 37 from entering into the current saturation region and eliminates excessive minority carrier injection into the base region of the transistor 37, thereby reducing a turn-off time of the transistor 37 that may be elongated due to a storage of minority carriers. Note that the operating point of the pnp transistor 37 enters in the active region only at the low gradation levels, thereby suppressing the increase of total heat generated in the display device, although the transistor operating at the active region dissipates large power. Then the high reliability of the display device in which a multitude of heat generating elements are assembled in a limited area is guaranteed.

Figure 3:
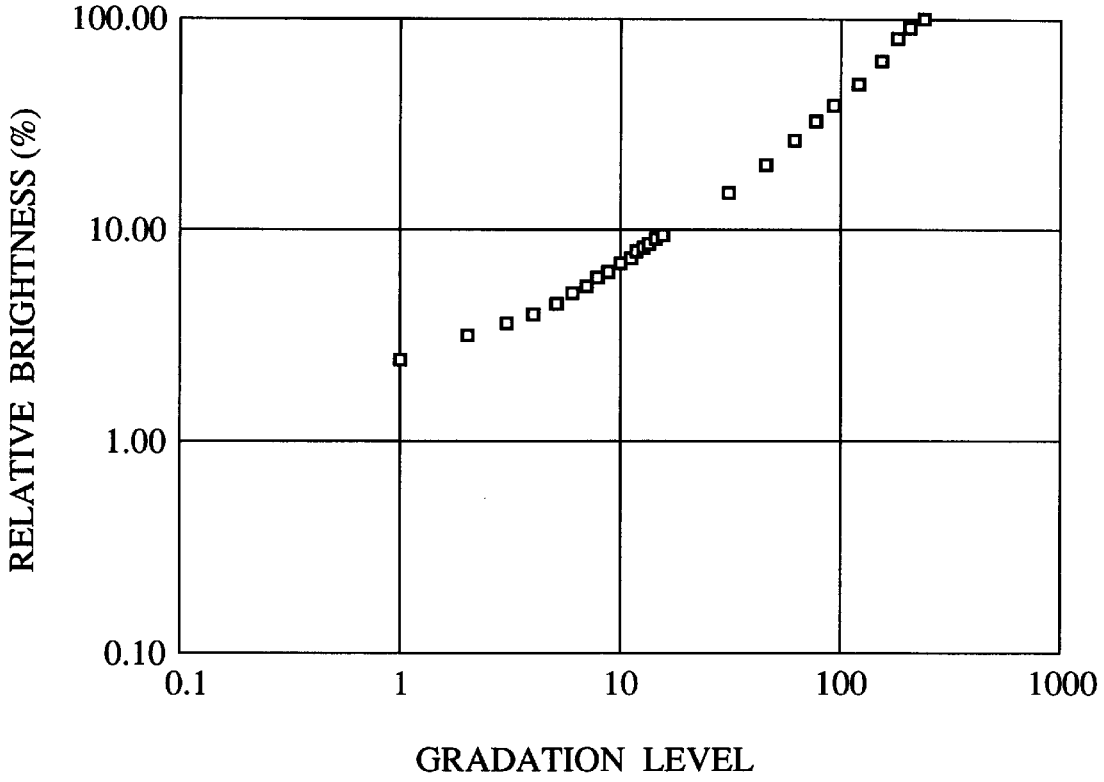
FIG.3 PRIOR ART
FIG. 3 is a graph showing relationships between gradation levels and relative brightness levels according to the prior art.
Figure 6:
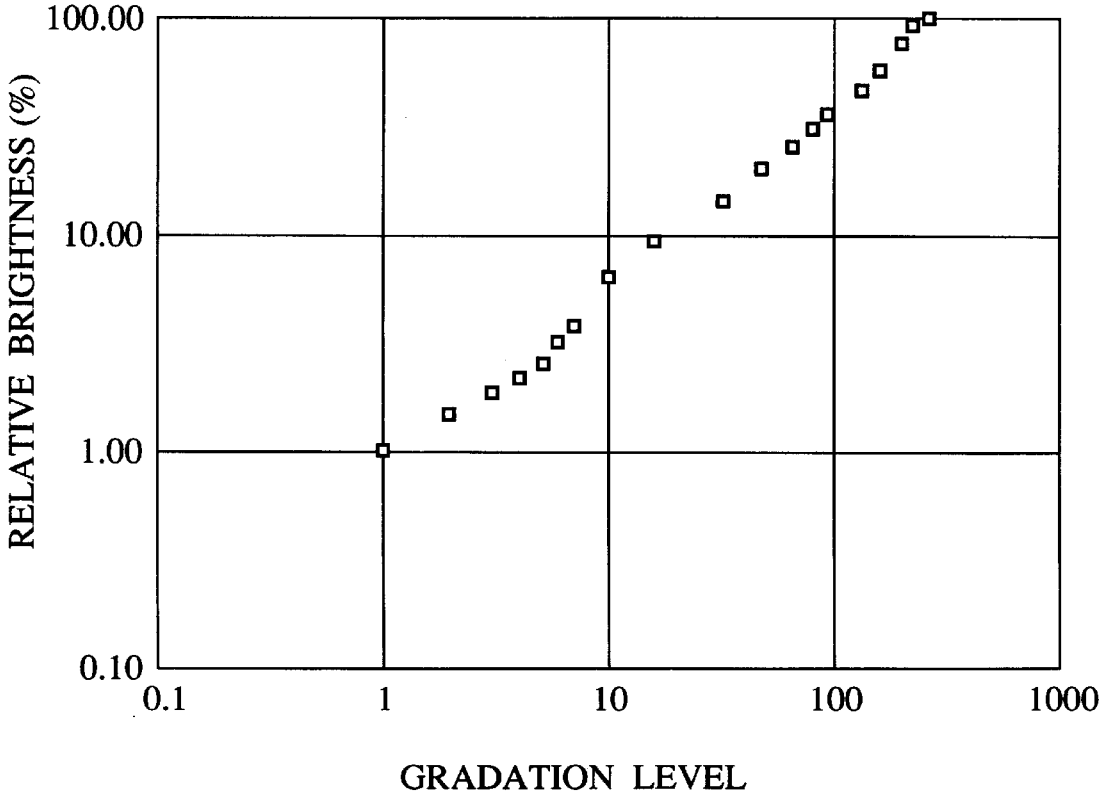
FIG. 6 is a graph showing relationships between gradation levels and relative brightness levels according to the present invention.
Figure 5:
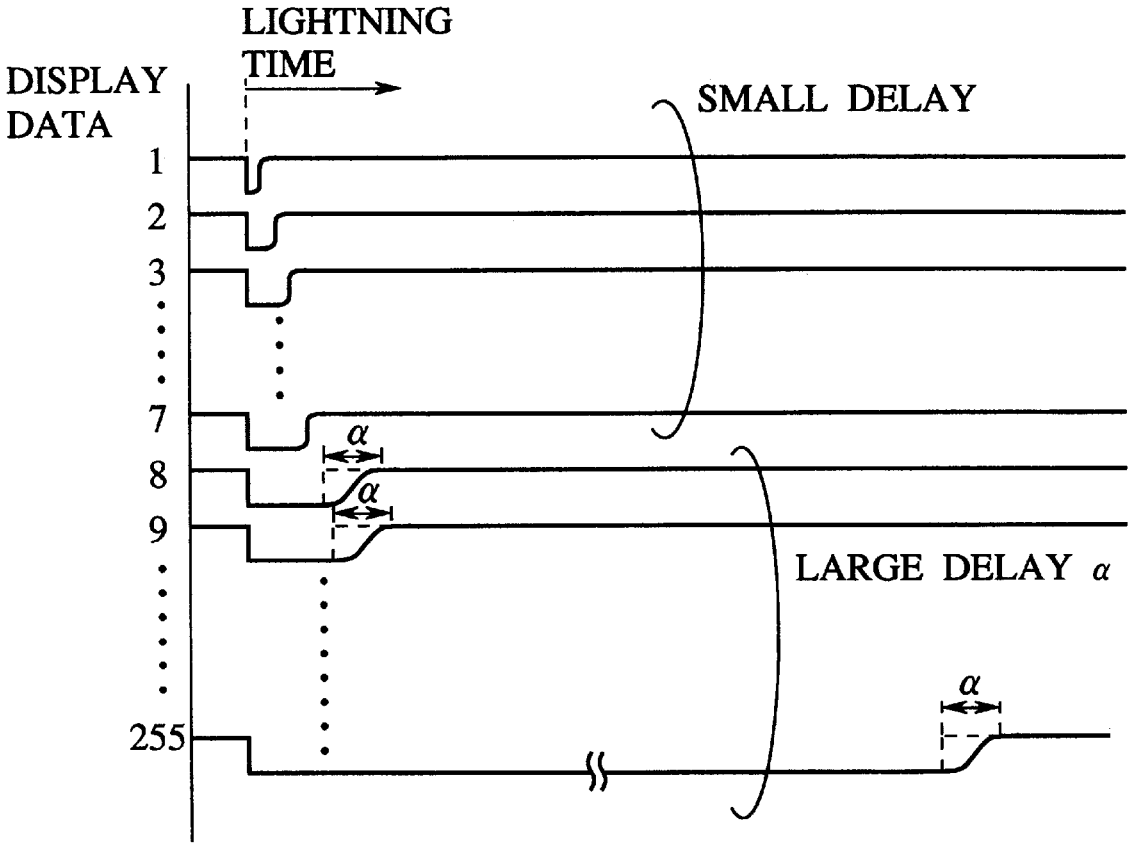
FIG. 5 shows lighting times corresponding to gradation levels displayed on the display device of the present invention.

As shown in FIG. 5, the present invention realizes ideal lighting times with a sharp turn-off characteristic on gradation levels 1 to 7. As a result, the gradation levels 1 to 7 are clear and distinguishable from one another. FIG. 6 is a graph showing relationships between display data and relative brightness according to the present invention. Compared with the prior art of FIG. 3, the graph of FIG. 6 shows improved linearity in relative brightness at low gradation levels. This means that the present invention is effective to improve contrast at these low gradation levels.

Although the above embodiment employs 8-bit display data and detects five upper bits of given 8-bit display data, the present invention is not limited to this. For example, the present invention is applicable to a 7-bit display data or a 9-bit display data. More generally, the present invention is applicable to display data consisting of N bits to represent the following number of gradation levels:

$$\sum_{n=1}^{N} 2^{n-1}$$

In this case, the present invention detects the fourth and upper bits counted from the least significant bit of given N-bit display data, to deal with an LED display device for displaying various gradation levels.

As mentioned above, the present invention provides a gradation controlled LED display device capable of securing linearity in relative brightness at low gradation levels and increasing contrast at the low gradation levels.

Various modifications will become possible for those skilled in the art after receiving the teachings of the present disclosure without departing from the scope thereof.

What is claimed is:

1. An LED display device comprising:

(a) an LED array having a matrix of LED chips;

(b) a data input control circuit for receiving display data, each piece of the display data being composed of a plurality of bits;

(c) a gradation control circuit for controlling the lighting times of the LED chips according to the display data so that the LED chips may provide gradation levels corresponding to the lighting times;

(d) a data driver having at least transistors for driving a predetermined number of the LED chips according to the lighting times;

(e) a base current control circuit for determining base currents supplied to the transistors of the data driver according to the display data; and (f) a scan circuit for scanning the predetermined number of the LED chips at a time, whenever the data driver drives the predetermined number of the LED chips.

2. The LED display device of claim 1, wherein the base current control circuit has a linearity adjusting circuit for detecting whether or not several upper bits of each display data piece are all "zero", and determines the level of each base current supplied to the transistors accordingly.

3. The LED display device of claim 2, wherein the base current control circuit has a base-resistance selector for selecting, for each of the transistors, one of two base resistors having different resistance values, and wherein the base-resistance selector selects the base resistor having a larger resistance value if the linearity adjusting circuit determines that all of several upper bits of a given display data piece are "zero", and selects the base resistor having a smaller resistance value if the linearity adjusting circuit determines that any one of the several upper bits is 1.

4. The LED display device of claim 2, wherein each display data piece consists of eight bits, and the linearity adjusting circuit detects five upper bits of the 8-bit display data.

5. The LED display device of claim 3, wherein each display data piece consists of eight bits, and the linearity adjusting circuit detects five upper bits of the 8-bit display data.

6. The LED display device of claim 2, wherein each display data piece consists of N (N≧7) bits, and the linearity adjusting circuit detects the fourth and upper bits counted from the least significant bit of given N-bit display data.

7. The LED display device of claim 3, wherein each display data piece consists of N (N≧7) bits, and the linearity adjusting circuit detects the fourth and upper bits counted from the least significant bit of given N-bit display data.

8. The LED display device of claim 2, wherein the linearity adjusting circuit has:

an upper bit detector for detecting upper bits of a given display data piece; and a decoder for converting the output of the upper bit detector into signals whose number is equal to the predetermined number of data lines connected to the predetermined number of the LED chips.

9. The LED display device of claim 3, wherein the linearity adjusting circuit has:

an upper bit detector for detecting upper bits of a given display data piece; and a decoder for converting the output of the upper bit detector into signals whose number is equal to the predetermined number of data lines connected to the predetermined number of the LED chips.

10. The LED display device of claim 3, wherein the base-resistance selector has, for each of the transistors of the data driver, an npn transistor having a base terminal electrically coupled with the gradation control circuit, an emitter terminal connected to a ground level, and a collector terminal connected to a parallel circuit composed of first and second series circuits, the first series circuit consisting of a first base resistor and a first switch, the second series circuit consisting of a second base resistor whose resistance is greater than that of the first base resistor, and a second switch.

11. The LED display device of claim 9, wherein the base-resistance selector has, for each of the transistors of the data driver, an npn transistor having a base terminal electrically coupled with the gradation control circuit, an emitter terminal connected to a ground level, and a collector terminal connected to a parallel circuit composed of first and second series circuits, the first series circuit consisting of a first base resistor and a first switch, the second series circuit consisting of a second base resistor whose resistance is greater than that of the first base resistor, and a second switch.

12. The LED display device of claim 11, wherein the first and second switches are turned on and off in response to the output of the decoder.

13. The LED display device of claim 8, wherein the number of the data lines are 32 for each of three primary colors, each display data piece is composed of eight bits, the upper bit detector detects five upper bits of 8-bit display data, and the decoder consists of two 4-to-16 decoders.

14. The LED display device of claim 13, wherein the base current control circuit has a base-resistance selector for selecting, for each of the transistors, one of two base resistors having different resistance values, and wherein the base-resistance selector selects the base resistor having a larger resistance value if the linearity adjusting circuit determines that all of several upper bits of a given display data piece are "zero", and selects the base resistor having a smaller resistance value if the linearity adjusting circuit determines that any one of the several upper bits is "1".

15. The LED display device of claim 13, wherein the base-resistance selector has, for each of the transistors of the data driver, an npn transistor having a base terminal electrically coupled with the gradation control circuit, an emitter terminal connected to a ground level, and a collector terminal connected to a parallel circuit composed of first and second series circuits, the first series circuit consisting of a first base resistor and a first switch, the second series circuit consisting of a second base resistor whose resistance is greater than that of the first base resistor, and a second switch.

16. The LED display device of claim 15, wherein the first and second switches are turned on and off in response to the output of the 4-to-16 decoders.

17. The LED display device of claim 2, further comprising a memory arranged between the data input control circuit and the gradation control circuit.

18. A method for controlling a display device, comprising the steps of:

determining whether or not several upper bits of a given display data piece are all "zero", the display data piece specifying a lighting time of one of LED chips arranged in a matrix;

selecting, according to a result of the determination, a base current supplied to a corresponding one of transistors in a data driver for driving data lines connected to a predetermined number of the LED chips, and turning on and off the transistors; and sequentially scanning the LED chip matrix scan line by scan line whenever driving the data lines.

19. The method of claim 18, wherein the base current is selected by switching base resistors connected to the base of the transistor in the data driver.

20. The method of claim 18, wherein each display data piece consists of N (N≧7) bits, and the determining step examines the fourth and upper bits counted from the least significant bit of a given N-bit display data piece.

* * * * *